US009546535B2

(12) United States Patent
Hayter et al.

(10) Patent No.: US 9,546,535 B2
(45) Date of Patent: Jan. 17, 2017

(54) PACKER PLUG WITH RETRACTABLE LATCH, DOWNHOLE SYSTEM, AND METHOD OF RETRACTING PACKER PLUG FROM PACKER

(71) Applicants: Steven R. Hayter, Houston, TX (US); Benjamin J. Farrar, Cypress, TX (US); Toby Lee Cochran, Crosby, TX (US)

(72) Inventors: Steven R. Hayter, Houston, TX (US); Benjamin J. Farrar, Cypress, TX (US); Toby Lee Cochran, Crosby, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 66 days.

(21) Appl. No.: 14/571,417

(22) Filed: Dec. 16, 2014

(65) Prior Publication Data

US 2016/0168947 A1 Jun. 16, 2016

(51) Int. Cl.

| | |
|---|---|
| ***E21B 33/12*** | (2006.01) |
| ***E21B 23/00*** | (2006.01) |
| ***E21B 33/129*** | (2006.01) |
| ***E21B 23/14*** | (2006.01) |
| ***E21B 31/12*** | (2006.01) |
| ***E21B 33/134*** | (2006.01) |
| ***E21B 23/02*** | (2006.01) |

(52) U.S. Cl.

CPC ..... *E21B 33/134* (2013.01); *E21B 23/02* (2013.01)

(58) Field of Classification Search

None

See application file for complete search history.

(56) References Cited

U.S. PATENT DOCUMENTS

| | | | | |
|---|---|---|---|---|
| 4,405,017 | A | 9/1983 | Allen et al. | |
| 4,576,236 | A | 3/1986 | Stout et al. | |
| 4,657,077 | A | 4/1987 | Smith et al. | |
| 4,928,768 | A | 5/1990 | Peterson | |
| 5,197,546 | A | 3/1993 | Murray | |
| 5,318,177 | A * | 6/1994 | Isacson | A45C 15/00 206/38.1 |
| 5,566,762 | A * | 10/1996 | Braddick | E21B 7/061 166/117.6 |
| 6,860,326 | B2 * | 3/2005 | Kilgore | E21B 23/06 166/120 |
| 6,959,759 | B2 * | 11/2005 | Doane | E21B 23/06 166/134 |
| 8,851,167 | B2 * | 10/2014 | Eriksen | E21B 7/20 166/124 |

(Continued)

OTHER PUBLICATIONS

"Model SB Latching Type Packer Plug and Model SB Latching Type Packer Plug with Support Mandrel and Surge Chamber", Product Family Nos. H66517, H66519 and H66520; Baker Hughes Sand Control Systems Catalog, 2010; p. 76.

(Continued)

*Primary Examiner* — Matthew R Buck
*Assistant Examiner* — Douglas S Wood
(74) *Attorney, Agent, or Firm* — Cantor Colburn LLP

(57) ABSTRACT

A packer plug includes a retractable latch having at least one radially compressible finger having threads on an exterior surface, and a housing operatively arranged to move the at least one radially compressible finger inwardly during longitudinal movement of the housing in an uphole direction.

17 Claims, 5 Drawing Sheets

(56) References Cited

U.S. PATENT DOCUMENTS

| | | | | |
|---|---|---|---|---|
| 2014/0305629 | A1 | 10/2014 | Bisset et al. | |
| 2016/0138363 | A1* | 5/2016 | Sommers | E21B 23/06 166/387 |
| 2016/0168938 | A1* | 6/2016 | Pray | E21B 23/06 166/377 |

OTHER PUBLICATIONS

"Multiple Zone Stack Gravel Pack System", Baker Hughes Sand Control Systems Catalog, 2010; p. 15.

* cited by examiner

PACKER PLUG WITH RETRACTABLE LATCH, DOWNHOLE SYSTEM, AND METHOD OF RETRACTING PACKER PLUG FROM PACKER

BACKGROUND

In the drilling and completion industry, the formation of boreholes for the purpose of production or injection of fluid is common.

Packers are used in many applications downhole to accomplish a sealing function against an interior wall of well casing or borehole wall, such as to fill an annular space between a pipe string and the well casing wall or borehole wall or to receive tools therein such as packer plugs. Packer plugs are used to convert packers to temporary bridge plugs. When installed in the packer, the plug permits operations such as pressure testing, perforating, and washing above the packer without affecting the zone below the packer.

The internal diameter of the packer includes a thread for the packer plug to latch into. The thread is typically a left-hand square thread with 90 degree flank angles. The preferred method of inserting the plug into the packer top sub is with a downward push. That is because left hand rotation would be required to thread the plug into the top sub and that action could unscrew joints in the workstring. In deeper wells it becomes difficult to apply enough torque at the surface so that the sufficient releasing torque is applied at the engagement of the latched tool so that it will release. Thus, in order to insert the plug with a downward push and disengage the tool with an upward pull with no twist, the lead in flank angle of the tool is selected to promote ease of snapping into the square thread of the packer, such as 40 degrees, to seal in the packer bore. The back angle of the tool is selected to allow the latch to be pulled out of the packer, such as 30 degrees.

The art would be receptive to alternative devices for latching and releasing tools from packer bores and for increasing the ratings of latched tools used in packers.

BRIEF DESCRIPTION

A packer plug includes a retractable latch having at least one radially compressible finger having threads on an exterior surface, and a housing operatively arranged to move the at least one radially compressible finger inwardly during longitudinal movement of the housing in an uphole direction.

A downhole system includes the packer plug and the threads of the at least one radially compressible finger include a trailing flank having a substantially 90 degree angle with respect to a longitudinal axis of the retractable latch. The downhole system also includes a packer having a square thread formed on an interior surface of the packer. The trailing flank is engaged with the square thread when the packer plug is received within the packer, and the trailing flank is moved radially inwardly away from the square thread during longitudinal movement of the housing in the uphole direction to retract the packer plug from the packer.

A packer plug includes a retractable latch having at least one radially compressible finger having threads on an exterior surface, and a face radially interior to the exterior surface. The packer plug further includes a housing having at least one protrusion having a ramp. Longitudinal movement of the housing relative to the retractable latch in an uphole direction moves the at least one radially compressible finger inwardly via camming engagement between the face and the ramp.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
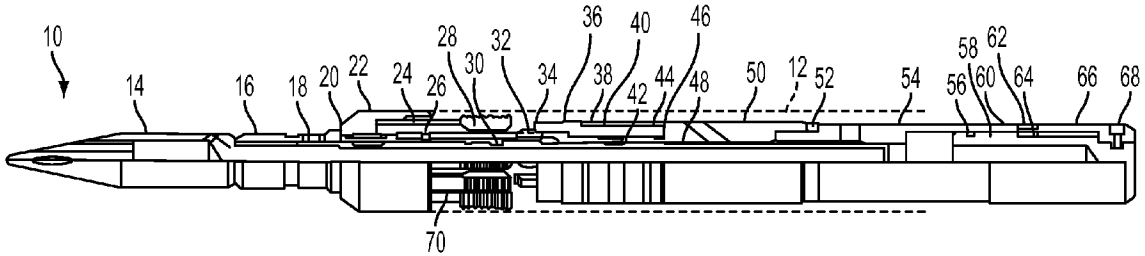
FIG. 1 is a partial sectional view of an embodiment of a packer plug, with a schematic of a packer shown in phantom.
Figure 2:
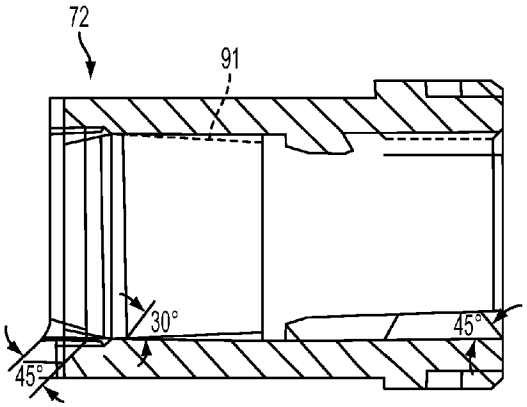
FIG. 2 is a top sub of a packer for receipt of a latch of the packer plug of FIG. 1.

An embodiment of a packer plug 10 is shown in FIG. 1. A body of a packer 12, within which the packer plug 10 may be seated for the purpose of blocking, or at least partially blocking, a flowpath through the packer 12, is shown in dashed lines. While features of the packer plug 10 may be altered to be accommodated in various packers 12 and for varying operational procedures, the illustrated packer plug 10 includes a control bar 14, connector sleeve 16, shear screw 18, upper (first portion) mandrel 20, latch nut 22, latch 24, set screw 26, lug housing 28, set screw 30, lower (second portion) mandrel 32, lug 34, seal sub 36, molded seals 38, o-ring 40, snap ring 42, spacer ring 44, o-ring 46, o-ring 48, support mandrel 50, set screw 52, bottom sub 54, O-ring 56, piston 58, set screw 60, lock ring retainer 62, body lock ring 64, shear housing 66, and shear screw 68. The latch 24 of the packer plug 10 has a thread profile machined on a group of collet fingers 70 that are able to deflect inward in order to remotely snap in place within the packer 12. Once in place, pressure from above (uphole) the packer plug 10 in downhole direction 74 will cause the packer plug 10 to shoulder on the top sub 72 (FIG. 2) of the packer 12. With pressure from below (downhole the plug 10) in uphole direction 76, however, the inner components of the plug 10 travel upward in direction 76 a short distance so that a set of lugs 34 riding on the OD of the mandrel 32 support the latch 24 to hold the plug 10 in place within the packer 12. That is, the latch 24 must support the load created by pressure acting downhole the plug 10. When the plug 10 is to be retrieved out of the packer 12, an overshot (not shown) is run into the borehole, in which the packer 12 is disposed, to grip the control bar 14 attached to the lower mandrel 32 (which is connected to mandrel portion 20) and a straight upward pull shears shear screws 18 allowing the lower mandrel 32 to travel in the uphole direction 76 so that the lugs 34 are no longer supported, thus freeing the collet fingers 70 for inward radial travel.

Figure 4:
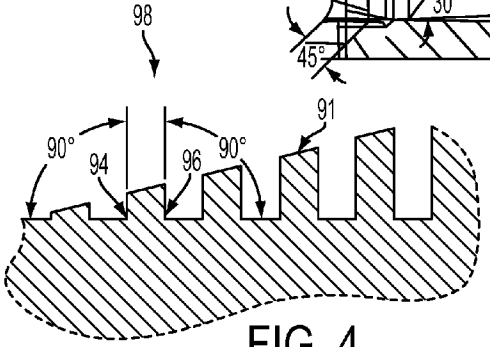
FIG. 4 is an embodiment of a square thread within the top sub of FIG. 2.
Figure 3:
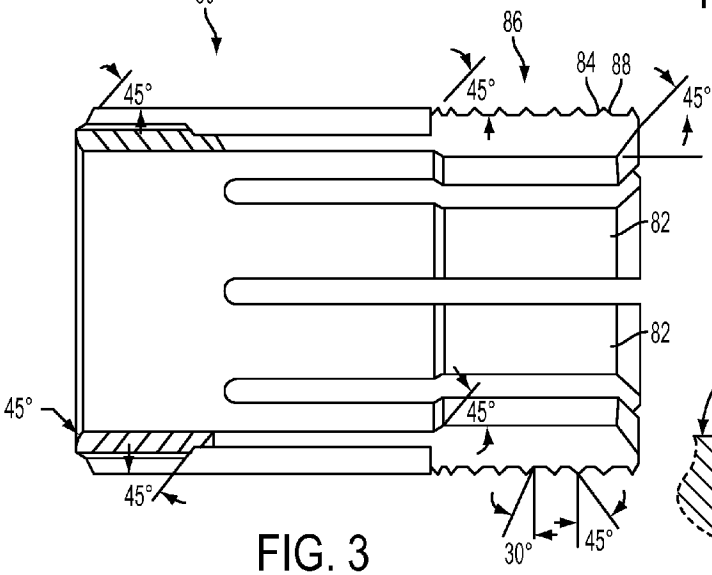
FIG. 3 PRIOR ART
FIG. 3 is a conventional latch according to the prior art.

A conventional latch 80 according to the prior art is shown in FIG. 3. The fingers 82 of the latch 80 are able to deflect radially inward when lugs, such as lugs 34, no longer support the fingers 82, so that the latch 80 can be freed from the packer top sub 72 and the packer plug pulled to surface. The overshot has little ability to transmit torque, and the only release motion available is a straight upward pull in the uphole direction 76. Therefore, the upper or trailing flank 84 of the thread 86 on the latch 80 has a beveled surface so that the pull in uphole direction 76 creates a radial force to deflect the collet fingers 82. The lead-in flank 88 has an angle of 30 degrees off vertical to promote ease of snapping into the left hand square thread of the packer top sub 72. The trailing flank 84 has an angle that is 45 degrees to allow the latch to be pulled out of the packer top sub 72. The packer top sub 72 is made with a tapered minor diameter 91 for threads 98, illustratively depicted in FIG. 4, to make snap-in of the latch 80 and latch 24 easier but with square flanks 94, 96 on both sides of the thread 98 (square flanks not shown in FIG. 2 for clarity). However, the design of latch 80 puts loading between the trailing flank 84 of the latch thread 86 (which has a 45 degree angle) with the 90 degree lower flank 96 on the top sub thread 98. Loading is concentrated at the line of contact. Furthermore, loading of the top sub thread 98 occurs at the crest of the threads 98. This contact can cause brandling or bending of either the thread 86 or 98 or both, which results in a lower differential pressure rating for a plug that includes the latch 80. It should be noted that if a latch with a square flank, not shown, was used, there would not be this concern. However, such a latch could only be removed by rotation, which cannot be provided by the overshot. Similarly, if other conventional threads such as an acme or stub acme were used on both latch and top sub threads, the mating flanks would have identical angles and the above-noted problem would not exist. However, a thread with a flank angle other than 90 degrees transfers radial loading to mating parts which is undesirable; plus, the preponderance of packers 12 are designed with left hand square threads with 90 degree flank angles.

Figure 5B:
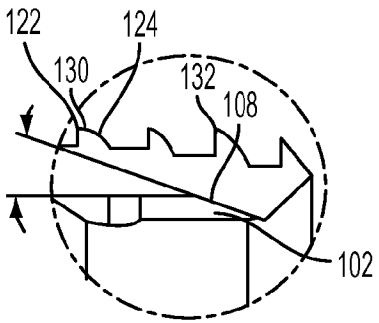
FIG. 5B is an enlarged view of area B in FIG. 5A.
Figure 5A:
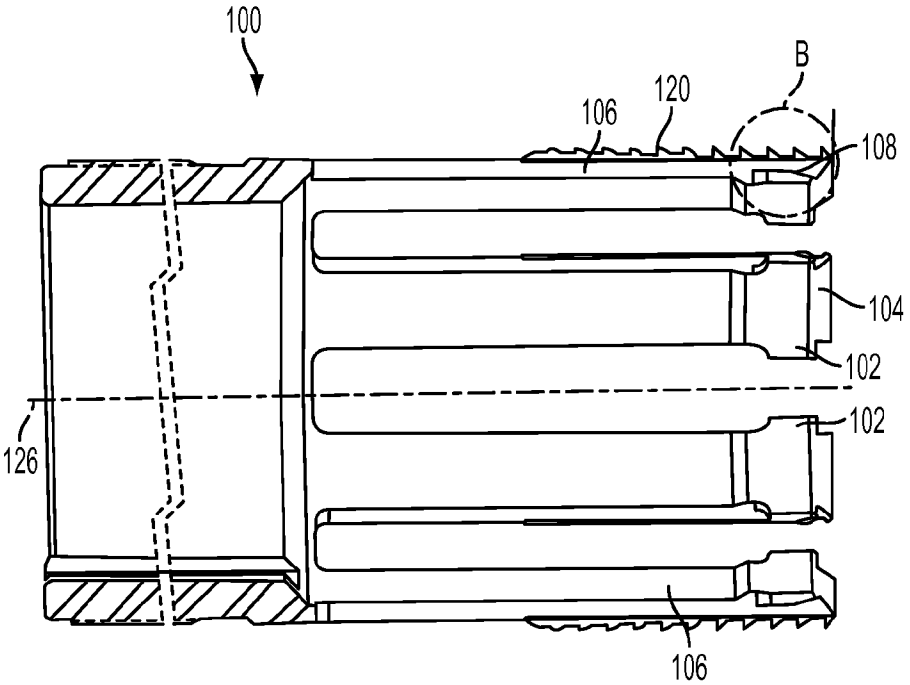
FIG. 5A is a sectional view of an embodiment of a retractable latch for the packer plug of FIG. 1.

With reference to FIGS. 5A and 5B, the packer plug 10 includes an improved latch 100 with tabs 102 having radially outwardly facing faces 108 with tapered angles machined, or otherwise disposed, on opposite sides of the end 104 of each retractable latch finger 106. The tabs 102 are provided on a radially inward side of the finger 106 for engagement with lug housing 110, as will be described below with respect to FIGS. 6A-6C, and threads 120 are provided on a radially outward side of the finger 106 for engagement with threads 98 in the packer top sub 72. The threads 120 include a trailing flank 122 and a lead-in flank 124. Like the latch 80, the lead-in flank 124 is angled with respect to longitudinal axis 126 to allow snap-in engagement into the packer top sub 72, such as approximately 45 degrees or other suitable oblique angle. Unlike the latch 80, however, the trailing flank 122 is substantially perpendicular with respect to the longitudinal axis 126 of the latch 100 such that the trailing flank 122 can rest substantially flush with the leading flank 96 of the packer top tub 72. As can be envisioned, even when the lugs 34 are no longer supporting the fingers 106, the latch 100 would not be removable from the packer top sub 72 with merely a force in the uphole direction 76. As will be further described below, the lug housing 110 is designed to force the fingers 106 radially inward so that the trailing flank 122 can be pulled radially inward and away from the threads 98.

Figure 6B:
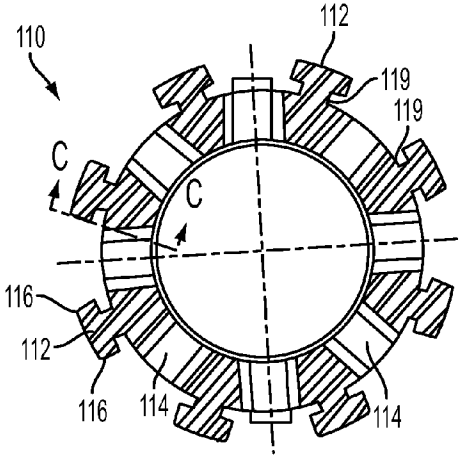
FIG. 6B is a cross-sectional view taken along line B-B in FIG. 6A.
Figure 6C:
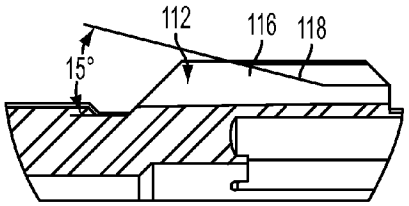
FIG. 6C is a sectional view taken along line C-C in FIG. 6B; and, FIG. 7 is a partial perspective view of the latch of FIGS. 5A-5B engaged with the lug housing of FIGS. 6A-6C in a radially outward position of the latch; and, FIG. 8 is a partial perspective view of the latch of FIGS. 5A-5B engaged with the lug housing of FIGS. 6A-6C in a radially inward position of the latch.
Figure 6A:
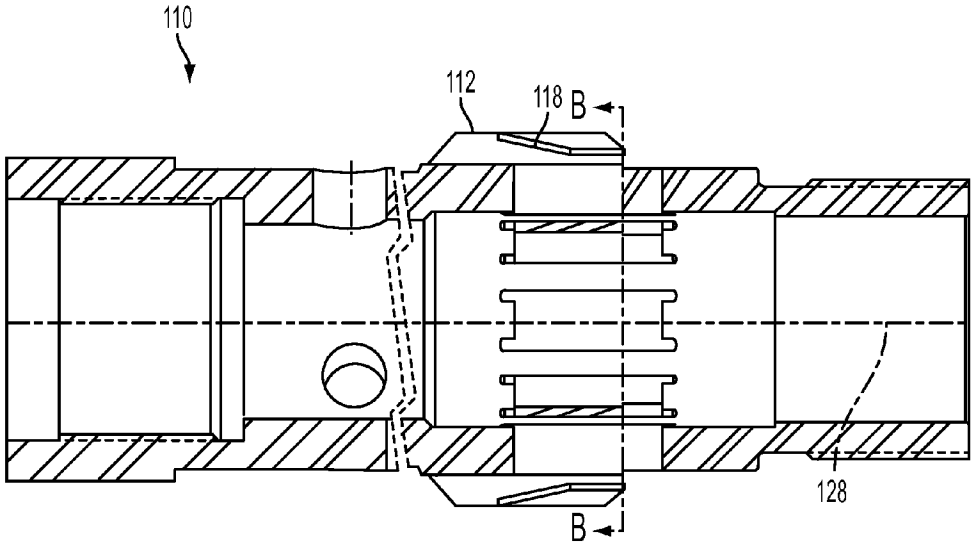
FIG. 6A is a sectional view of an embodiment of a lug housing for retractable latch for the packer plug of FIG. 1.

With reference to FIGS. 6A-6C, lug housing 110 will be machined, or otherwise provided, with protrusions 112 rising from the OD between windows 114 that house the lugs 34 (FIG. 1) that support the fingers 106 (FIG. 5A). On opposing sides 116 of each protrusion 112 will be machined a ramp 118 along slot 119 with angles matching those on the faces 108 of the tabs 102 of the retractable latch 100. For example, both the ramp 118 and the face 108 may form approximately a 15 degree angle with respect to the longitudinal axes 126 and 128. The ramp 118 faces substantially radially inward to engage with the substantially radially outward facing face 108. In this manner, a tab and slot arrangement will exist for each retractable latch finger 106. When the plug 10 having the latch 100 and lug housing 110 is to be removed, an upward pull on the overshot in the uphole direction 76 will be transmitted to the lug housing 110. As the lug housing 110 travels in the uphole direction 76, the angled ramps 118 of the lug housing 110 will contact the angled tabs 102 of the retractable latch fingers 106 which are engaged in the packer top sub thread 98. Further travel will cam the ramps 118 and faces 108 with respect to each other and force the retractable latch fingers 106 radially inward encouraging the 90 degree flank angles of flanks 122 of the fingers 106 to travel essentially parallel to the 90 degree flank angles of flanks 96 of the top sub 72, thus releasing the plug 10. The fingers 106 are cammed radially inward via engagement of the fingers 106 with the lug housing 110 until at least a major diameter of the threads 120 of the latch 100 is less than a minor diameter of the square threads 98 of the top sub 72 to allow the retraction of the packer plug 10 from the packer 12. Via entrapment of the tabs 102 in the radially restricted portion of the slots 119, the lug housing 110 restrains the fingers 106 radially inward during retraction of the packer plug 10 from the packer 12.

Figure 7:
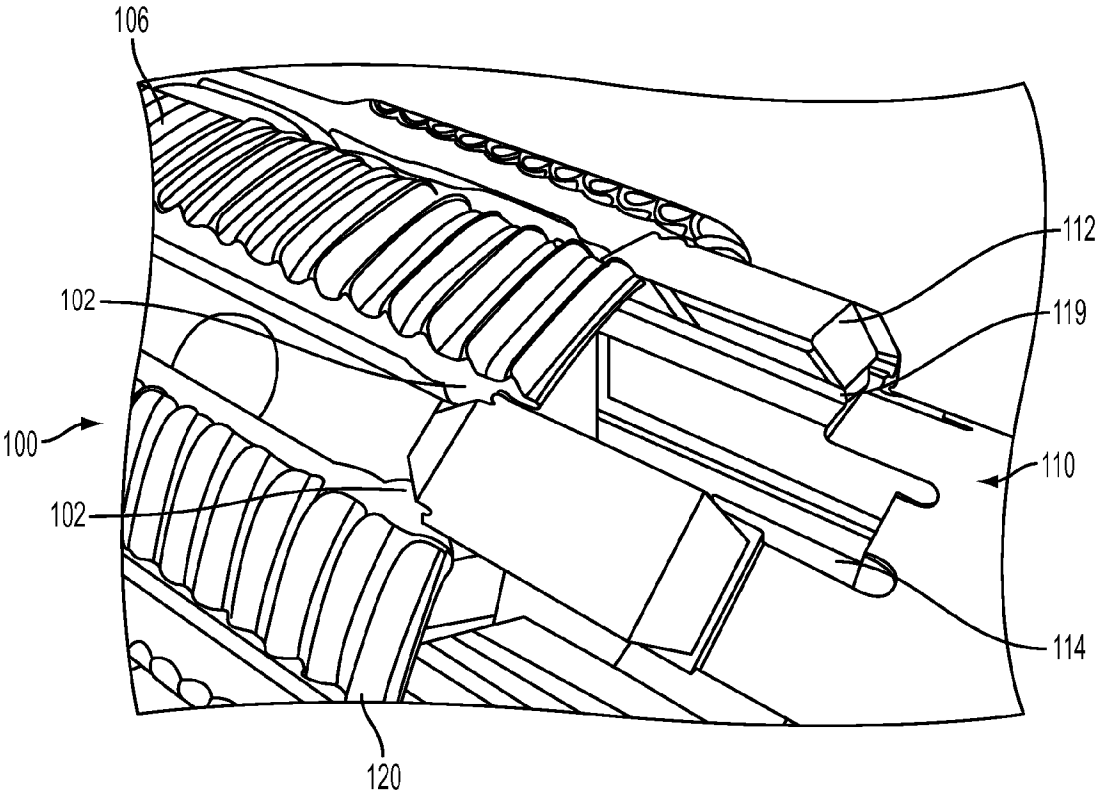
Figure 8:
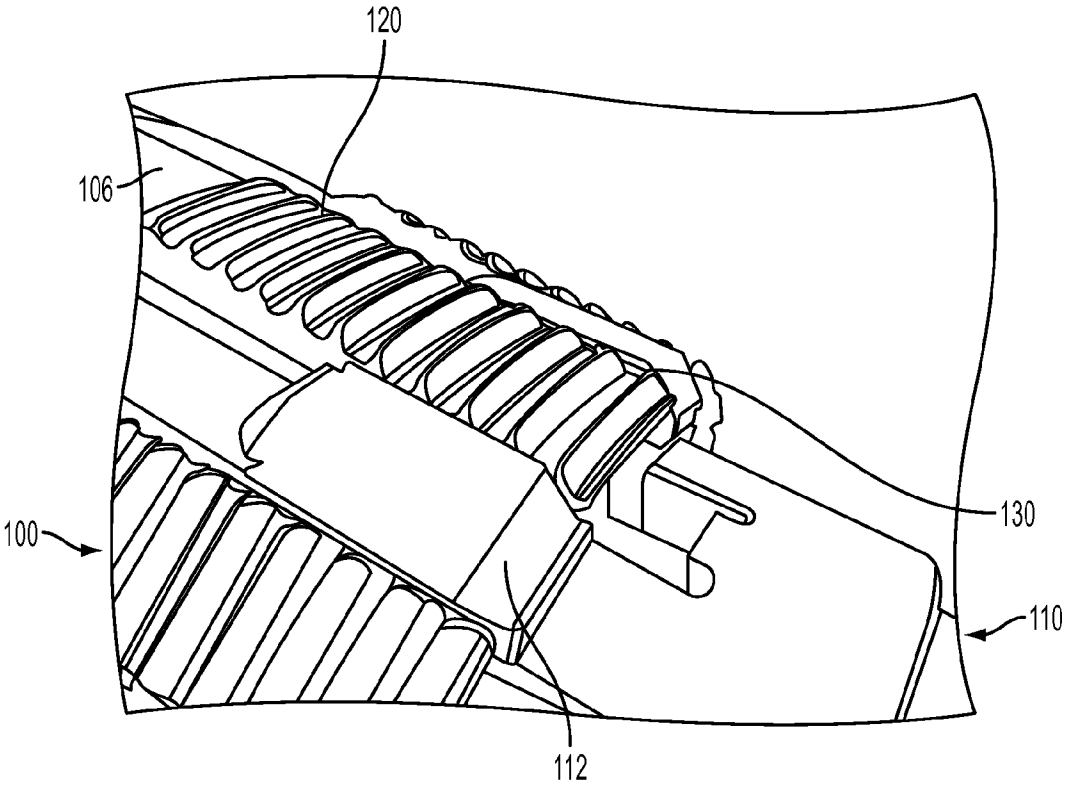

Interaction between the protrusions 112 of the lug housing 110 and the fingers 106 of the latch 100 is demonstrated in FIGS. 7 and 8. FIG. 7 demonstrates an expanded condition of the fingers 106, such as would be experienced when the threads 120 of the latch 100 engage with the threads 98 of the top sub 72. The lugs 34 (shown in FIG. 1 but not in FIG. 7) are supported and protrude through the windows 114 and prevent the fingers 106 of the latch from camming inward radially. FIG. 8 demonstrates a retracted condition of the fingers 106, such as would be experienced with the lugs 34 are no longer supported by lower mandrel 32, allowing uphole movement of lug housing 110 forcing tabs 102 on fingers 106 to slide within slot 119 which retracts the fingers 106 radially inwardly. As can be seen by comparing FIGS. 7 and 8, when the ramp 118 is drawn across the fingers 106, the crest 130 of the threads 120 move from a larger OD than the protrusions 112, to a smaller OD, as can be seen in relation to the OD of the protrusions 112. The retracted fingers 106 enable the packer plug 10 to be removed from the packer 12.

Thus, a retractable latch 100 and lug housing 110 are designed with angled tabs 102 and slots 119 so that an upward pull in the uphole direction 76 on the lug housing 110 forces inward radial deflection of the latch fingers 106. That radial deflection allows the 90 degree flank angles on the retractable latch thread 120 to release from the mating flank angle of the thread 98 in the packer top sub 72. Without this special release motion, the flank angle of the latch 100 could not be 90 degrees and the pressure rating of the plug 10 would be significantly lower.

The 90 degree flank angle of the trailing flanks 122 on the retractable latch 100 optimizes the loading with the top sub left hand square threads 98. Mechanically-induced radial deflection of the fingers 106 is required, however, in order to get the 90 degree flanks 122 and 96 to release from one another. Significantly higher differential pressure ratings from below can be achieved with this retractable latch design. Number and size of retractable latch collet fingers 106 and lug housing protrusions 112 could be varied. While a 15 degree angle has been described for the ramps 118 and face 108, angles on the ramps 118 and face 108 could be varied, and may not necessarily match. While the latch 100 is described as having tabs 102 and the lug housing 110 is described as having slots 119, the latch 100 could instead be provided with the slots 119 and the latch housing 110 with the tabs 102. A compound angle (90 degrees for the majority of the thread flank near the root; and, for example, 85 degrees for a short distance near the crest 130) could be machined on the retractable latch fingers 130 for smoother release. A slight chamfer 132 at the crest 130 of the thread 120 of the retractable latch 100 could achieve the same effect. While the slots 119 and tabs 102 are described and illustrated as on both sides of the protrusions 112 and fingers 106, alternatively slots 119 and tabs 102 could be positioned on only one side of each protrusion 112 and finger 106. For ease of manufacturing, the ramps 118 could be made as separate components subsequently attached to the lug housing 110 with fasteners or by welding. Special coatings could be used on either the retractable latch 100 or lug housing 110 to reduce friction and ease release. Also, while lugs have been described, other mechanical devices to prevent inward radial deflection of the latch fingers could be employed, such as, but not limited to, ends of another collet.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A packer plug seatable within a packer and configured to block a flowpath through an interior of the packer, the packer plug comprising:

a retractable latch having at least one radially compressible finger having threads on an exterior surface of the at least one radially compressible finger, the threads engageable with interior threads of the packer, the at least one radially compressible finger further having a face, the face facing substantially radially outward; and, a housing having a ramp, the ramp facing substantially radially inward, the housing operatively arranged to cam the face of the at least one radially compressible finger of the latch radially inwardly during sliding engagement of the ramp along the face during longitudinal movement of the housing relative to the latch;

wherein the ramp of the housing is configured to restrain the at least one radially compressible finger radially inward during retraction of the packer plug from the packer.

2. The packer plug of claim 1, wherein the face is radially interior to the exterior surface, and the housing including at least one protrusion having the ramp, the ramp arranged to cam the face radially inwardly during longitudinal movement of the housing in an uphole direction.

3. The packer plug of claim 2, wherein the face has an acute angle relative to a longitudinal axis of the retractable latch, and the ramp has an acute angle relative to a longitudinal axis of the housing.

4. The packer plug of claim 3, wherein the angle of the face is substantially same as angle of ramp.

5. The packer plug of claim 2, wherein the face is formed on a tab of the at least one radially compressible finger and the ramp is formed within a slot in the at least one protrusion of the housing.

6. The packer plug of claim 5, wherein opposing sides of each of the at least one radially compressible finger includes the tab, the opposing sides disposed between the exterior surface and an interior surface of the at least one radially compressible finger, and opposing sides of each of the at least one protrusion includes the slot.

7. The packer plug of claim 1, wherein the housing is disposed at least partially radially inward of the latch.

8. The packer plug of claim 1, wherein the threads include a trailing flank having a substantially 90 degree angle with respect to a longitudinal axis of the retractable latch.

9. The packer plug of claim 8, wherein the lead-in flank angle of the threads on the at least one radially compressible finger is oblique.

10. The packer plug of claim 8, wherein the threads are chamfered at a crest of each thread.

11. The packer plug of claim 1, wherein the housing is a lug housing with at least one window sized to accept lugs therethrough.

12. The packer plug of claim 1, wherein the housing includes at least one window, the at least one radially compressible finger at least partially disposed in the at least one window, wherein longitudinal movement of the housing relative to the retractable latch in an uphole direction moves the at least one radially compressible finger radially toward the at least one window.

13. A downhole system comprising:

a packer plug including:

a retractable latch having at least one radially compressible finger having threads on an exterior surface, the threads of the at least one radially compressible finger include a trailing flank having a substantially 90 degree angle with respect to a longitudinal axis of the retractable latch; and, a housing operative arranged to move the at least one radially compressible finger inwardly during longitudinal movement of the housing in an uphole direction; and, a packer having a square thread formed on an interior surface of the packer;

wherein the trailing flank is engaged with the square thread when the packer plug is received within the packer, and the trailing flank is moved radially inwardly away from the square thread during longitudinal movement of the housing in the uphole direction to retract the packer plug from the packer.

14. A method of retracting a packer plug from a packer, the packer plug having exterior threads on radially compressible fingers of a retractable latch, the exterior threads meshed with interior square threads of the packer, the method comprising:

applying force in an uphole direction on a mandrel of the packer plug;

moving a housing of the packer plug with the mandrel in the uphole direction with respect to the latch of the packer plug;

camming the fingers radially inward via engagement of the fingers with the housing until at least a major diameter of the exterior threads is less than a minor diameter of the square threads; and, retracting the packer plug including the retractable latch longitudinally from the packer.

15. The method of claim 14, wherein the exterior threads on the radially compressible fingers of the retractable latch include a trailing flank having a substantially 90 degree angle with respect to a longitudinal axis of the retractable latch.

16. The method of claim 14, wherein camming the fingers radially inward via engagement of the fingers with the housing includes sliding an angled face of the fingers against an angled ramp of the lug housing.

17. The method of claim 14, wherein the housing restrains the fingers radially inward during retraction of the packer plug from the packer.

* * * * *